US007534069B1

(12) United States Patent
Stanley

(10) Patent No.: US 7,534,069 B1
(45) Date of Patent: May 19, 2009

(54) PROGRAMMABLE BOATLIFT SYSTEM WITH BOAT POSITION SENSOR

(76) Inventor: James C. Stanley, 14005 Cooperton Cir., Chester, VA (US) 23836

( * ) Notice: Subject to any disclaimer, the term of this patent is extended or adjusted under 35 U.S.C. 154(b) by 0 days.

(21) Appl. No.: 11/937,937

(22) Filed: Nov. 9, 2007

(51) Int. Cl.
*B63C 3/12* (2006.01)

(52) U.S. Cl. ..... 405/3; 114/44

(58) Field of Classification Search ..... 114/44, 114/45, 48; 405/3
See application file for complete search history.

(56) References Cited

U.S. PATENT DOCUMENTS

| | | | | |
|---|---|---|---|---|
| 3,139,732 | A | 7/1964 | Thompson | |
| 3,691,363 | A * | 9/1972 | Armistead | 702/6 |
| D271,687 | S | 12/1983 | Griffiths | |
| 4,763,592 | A | 8/1988 | Russ | |
| 5,226,746 | A * | 7/1993 | Johnson | 405/3 |
| D376,244 | S | 12/1996 | Feider et al. | |
| 5,593,247 | A | 1/1997 | Endres et al. | |
| 6,003,463 | A | 12/1999 | Giesler | |
| 6,537,010 | B2 | 3/2003 | Martin et al. | |
| 6,543,375 | B1 | 4/2003 | Sargent et al. | |
| 6,554,533 | B2 | 4/2003 | Godbersen | |
| 6,823,809 | B2 | 11/2004 | Hey | |
| 7,090,431 | B2 | 8/2006 | Cosgrove et al. | |
| 7,207,746 | B1 | 4/2007 | Legun | |
| 2004/0089212 | A1 | 5/2004 | Vinnik | |
| 2005/0183648 | A1 | 8/2005 | Basta | |

FOREIGN PATENT DOCUMENTS

| | | |
|---|---|---|
| WO | WO/91/14619 | 10/1991 |

* cited by examiner

*Primary Examiner*—Sunil Singh
(74) *Attorney, Agent, or Firm*—Gerald M. Walsh; Kenneth M. Bush; Buch Intellectual Property Law

(57) ABSTRACT

A programmable boatlift system having a cable extending up from one end of a boatlift cradle, across to a shaft attached to a motor, and down to an opposite end of the boatlift cradle. The cable passes through a hole in the shaft. A position sensor having an idler sheave is placed on the cable. The motor winds or unwinds the cable around the shaft to cause the cable to move across the roller sheave to raise or lower the boatlift cradle. The position sensor produces an output signal proportional to the distance the cable travels over the idler sheave as the cable causes the idler sheave to rotate. An electronic control circuit uses the output signal to infer the vertical position of the boatlift cradle and to position the boatlift cradle as desired.

6 Claims, 8 Drawing Sheets

PROGRAMMABLE BOATLIFT SYSTEM WITH BOAT POSITION SENSOR

FIELD OF THE INVENTION

The present invention relates to a programmable boatlift system, and, more particularly, to a boat lift system that indicates the exact position of the boat within the lift system.

BACKGROUND OF THE INVENTION

Programmable boat lift systems are known but they require two cables on each side of the boat, two at the front and two at the rear of the boat. Two motors are required, one for each side of the boat to operate the cables. The use of level sensors is known to stop or start the motor to position the boat as desired, but these sensors must be placed near the boat and move up and down with the boat. They require the use of mercury switches and float switches and can be exposed to water as the boat is placed into the water. The plurality of motors, cables, and sensors in these systems create a need for constant maintenance and repair. A cable system for a boat lift using a single motor is known but it is not suitable for detecting the position of the boat within the lift system.

What is needed is a boatlift system that operates with a single motor, with a single cable at the front of the boat, a single cable at the back of the boat, and a simple sensor that measures the actual position of the boat within the boat lift, so that a remote, programmable unit can position the boat automatically as desired.

SUMMARY OF THE INVENTION

The present invention is a boat lift system having a boatlift structure with a front end, a back end, and vertical and horizontal support beams. Boatlift cradles are positioned among the support beams and are connected to the upper portion of the boatlift structure by a steel cable at the front of the boatlift structure and a steel cable at the back end of the boatlift structure. The cables extend from one side of the cradle upwards towards a pulley, horizontally across the boatlift structure towards a shaft rotated by a motor, through a hole in the shaft, and downward to the lift cradle. An idler sheave is placed on one of the cables on the portion that extends horizontally across the boat lift structure. The sheave is fitted with a quadrature encoder to produce an electronic signal proportioned to the number of rotations of the sheave as the cable moves across the sheave during lifting or lowering of the lift cable. The signal from the encoder is sent to an electronic control circuit which uses the encoder signal to infer the vertical position of the boat or lift cradle within the boatlift structure. The electronic control circuit consists of a microcontroller with non-volatile memory, oscillator, and related circuitry for receiving and sending electronic signals. The electronic control circuit will also receive signals from a user input keypad which allows a user to invoke the end functions of the programmable boatlift system, and the electronic control circuit will send signals to the motor to turn the boat motor on and off, in either direction based upon the programming in the electronic control circuit. Because the boat position sensor provides the exact vertical position of the boat within the boatlift structure, limit sensors, float sensors, moisture sensors, and timers are not required for operation of the boatlift system.

An advantage of the present invention is a programmable boatlift system that requires only two cables.

Another advantage is a single boat position sensor which determines the exact position of the boat within the boat structure.

Another advantage is a single motor to raise and lower the boat.

Another advantage is a simple, durable, idler sheave with a quadrature encoder to sense the boat position.

Another advantage is a programmable control unit with a remote control to automatically position the boat within the boat lift structure.

DETAILED DESCRIPTION OF THE PREFERRED EMBODIMENTS

Figure 1:
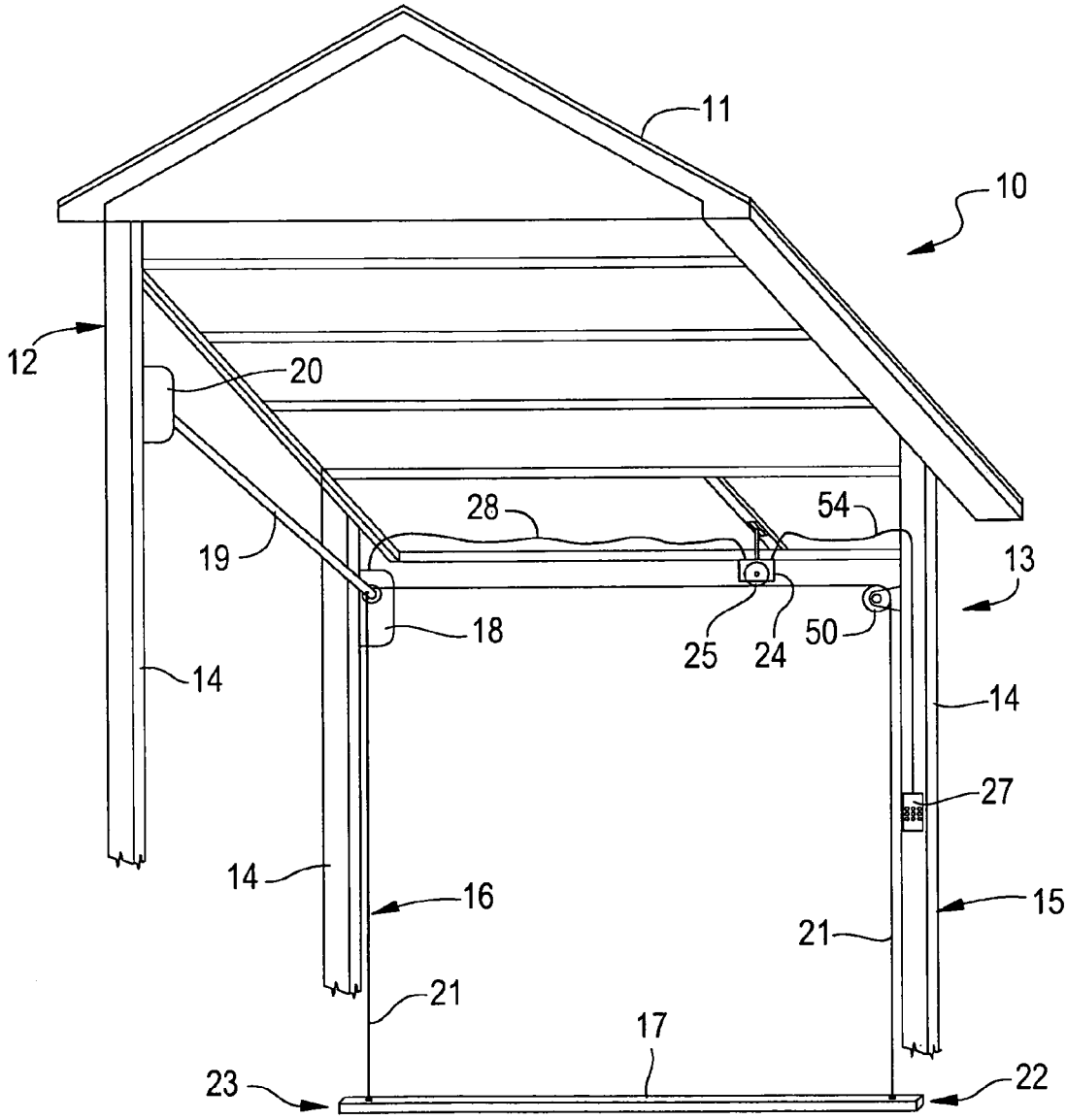
FIG. 1 shows the boatlift structure of the programmable boatlift system of the present invention.

FIG. 1 shows the boatlift structure 11 of the boatlift system 10 of the present invention. The boatlift structure 11 has a front end 12 and a back end 13. The boatlift structure 11 is supported by four vertical beams 14, and has right side 15 and left side 16. A boatlift cradle 17 is suspended by a cable 21 from the upper ends of beams 14. A motor 18 is attached to the upper end of a beam 14 at the back end 13 and left side 16 of the boatlift structure 11. The motor 18 has shaft 19 that extends from the motor 18 to a bearing 20 attached at the upper end of a beam 14 at the front end 12 and left side 16 of the boatlift structure 11. Bearing 20 supports shaft 19 as motor 18 rotates shaft 19.

Cable 21 is attached to one side 22 of boatlift cradle 17 and extends upward therefrom to pulley 50, from there across to shaft 19, and from there down to the opposite side 23 of boatlift cradle 17. A boat position sensor 24 is attached to boatlift structure 11 and engages cable 21 by means of an idler sheave 25. The boat position sensor 24 is connected electrically to motor 18 by a wire 28 and to a user key pad interface 27 by a wire 54.

Figure 2:
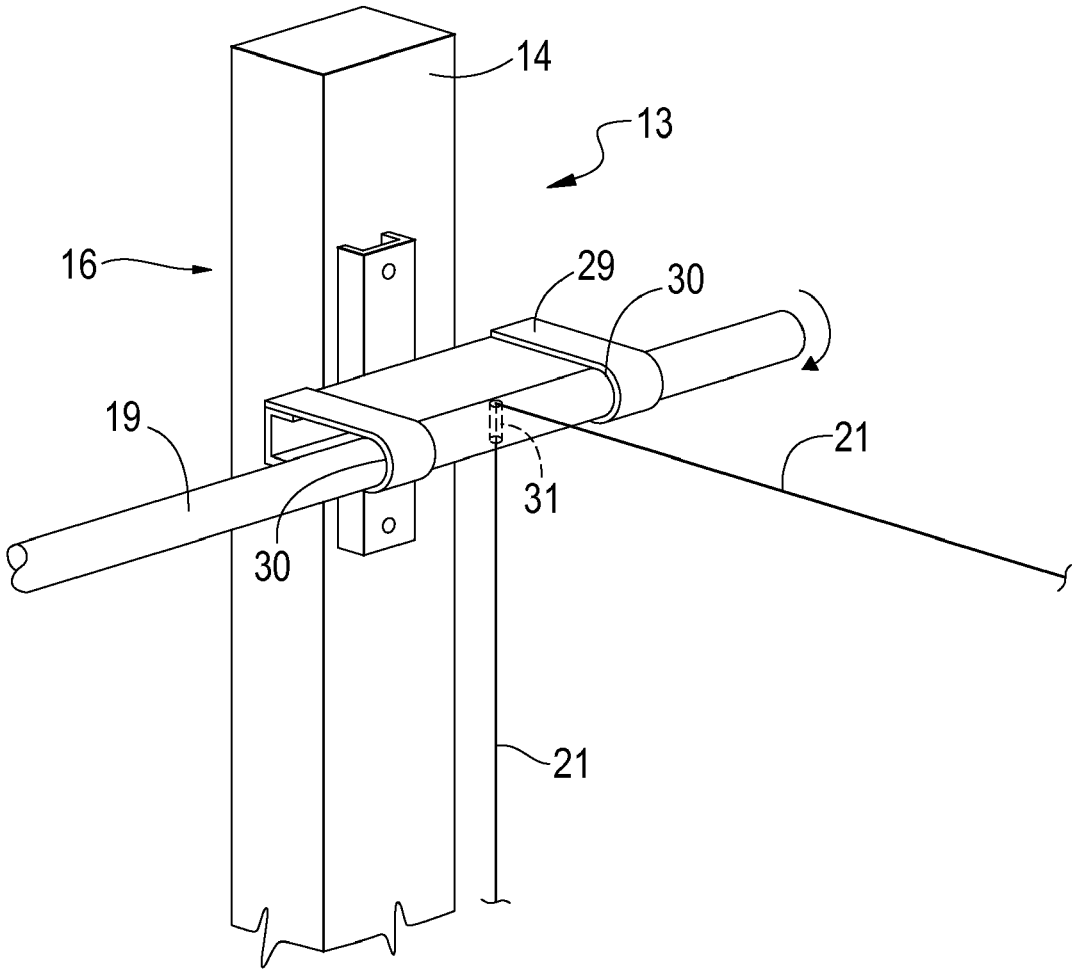
FIG. 2 shows the winch mechanism of the present invention.

FIG. 2 shows the shaft 19 attached to a beam 14 by a bracket 29 at back end 13, right side 16 of boatlift structure 11. The shaft 19 is supported by bearings 30. Shaft 19 has hole 31 through which cable 21 is inserted. As motor 18 turns the portions of cable 21 extending upward from each side 22, 23 of boatlift cradle 17 are wound around shaft 19 in the same direction. The portions of the cable attached to sides 22, 23 of boatlift cradle 17, thus, lift or lower boatlift cradle 17 in a level horizontal position. Although not shown, a similar cable and boatlift cradle arrangement is at the front end 12 of boatlift structure 11, wherein the cable passes through a second hole in shaft 19. Thus, there are two boatlift cradles, each with its own cable arrangement wherein the cables lift or lower both boatlift cradles in unison as the motor 18 rotates shaft 19 which acts as a winch. With a boatlift cradle at the front of a boat and at the rear of the boat, the rotation of shaft 19 by motor 18 will raise and lower the boat in a level position, both horizontally and vertically.

Figure 3:
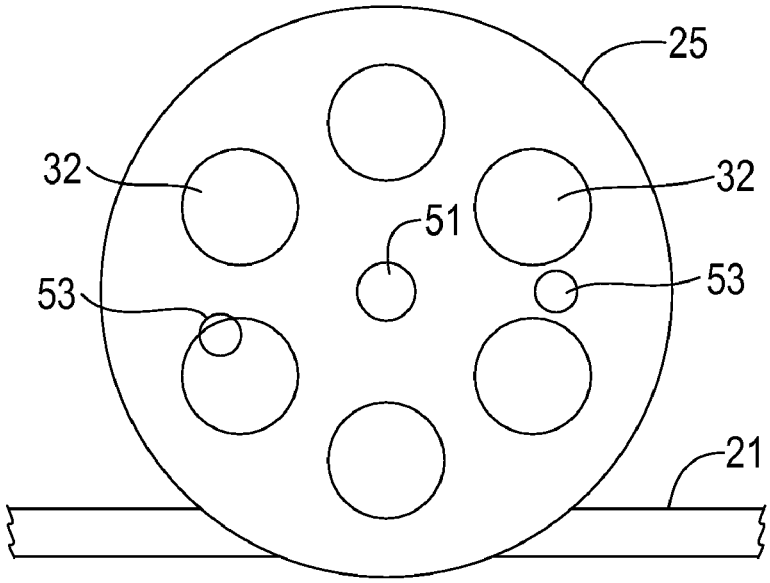
FIG. 3 shows the idler sheave with IR detectors engaging the lift cable.
Figure 4:
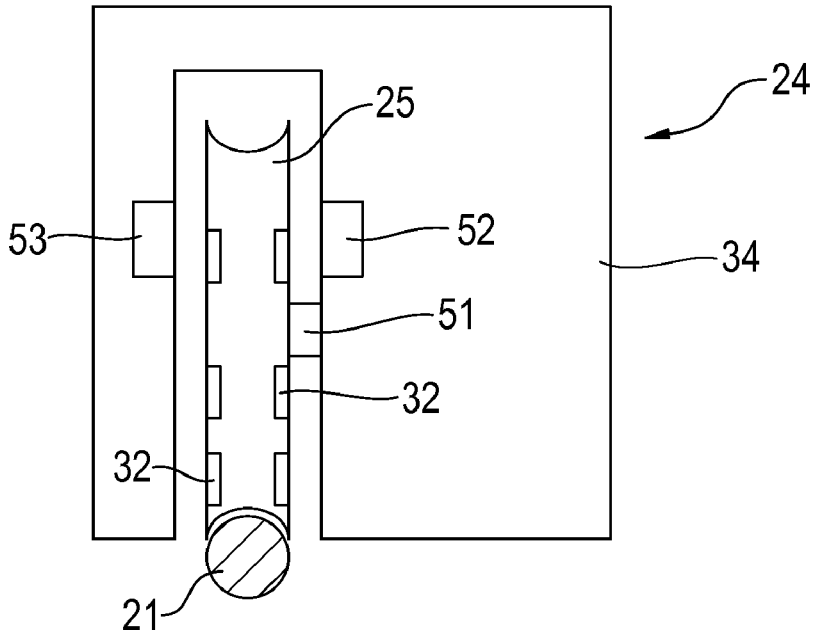
FIG. 4 shows a view of the idler sheave and quadrature encoder viewed along the length of the cable.

FIG. 3 shows the idler sheave 25 of the boat position sensor 24 in place on cable 21. Sheave 25 rotates on an axle 51. Sheave 25 has a plurality of holes for transmission of infrared (IR) light which is detected by IR detectors 53. FIG. 4 shows the boat position sensor 24 looking downline along cable 21. FIG. 4 further shows a quadrature encoder 34 in place over idler sheave 25 and IR transmitters 52. The detection of the IR signal through holes 32 in the sheave 25, as the sheave 25 is rotated by cable 21, allows the encoder 34 to produce an output signal directly proportional to the distance cable 21 has traveled as it raises or lowers the boatlift cradle 17. Thus, this output signal is directly proportional to the absolute amount a boat in the boatlift cradle 17 has been raised or lowered by the cables. The two pairs of IR transmitters 52 and receivers 53 are set, preferably, about 165° apart relative to axle 51 of sheave 25.

Figure 5:
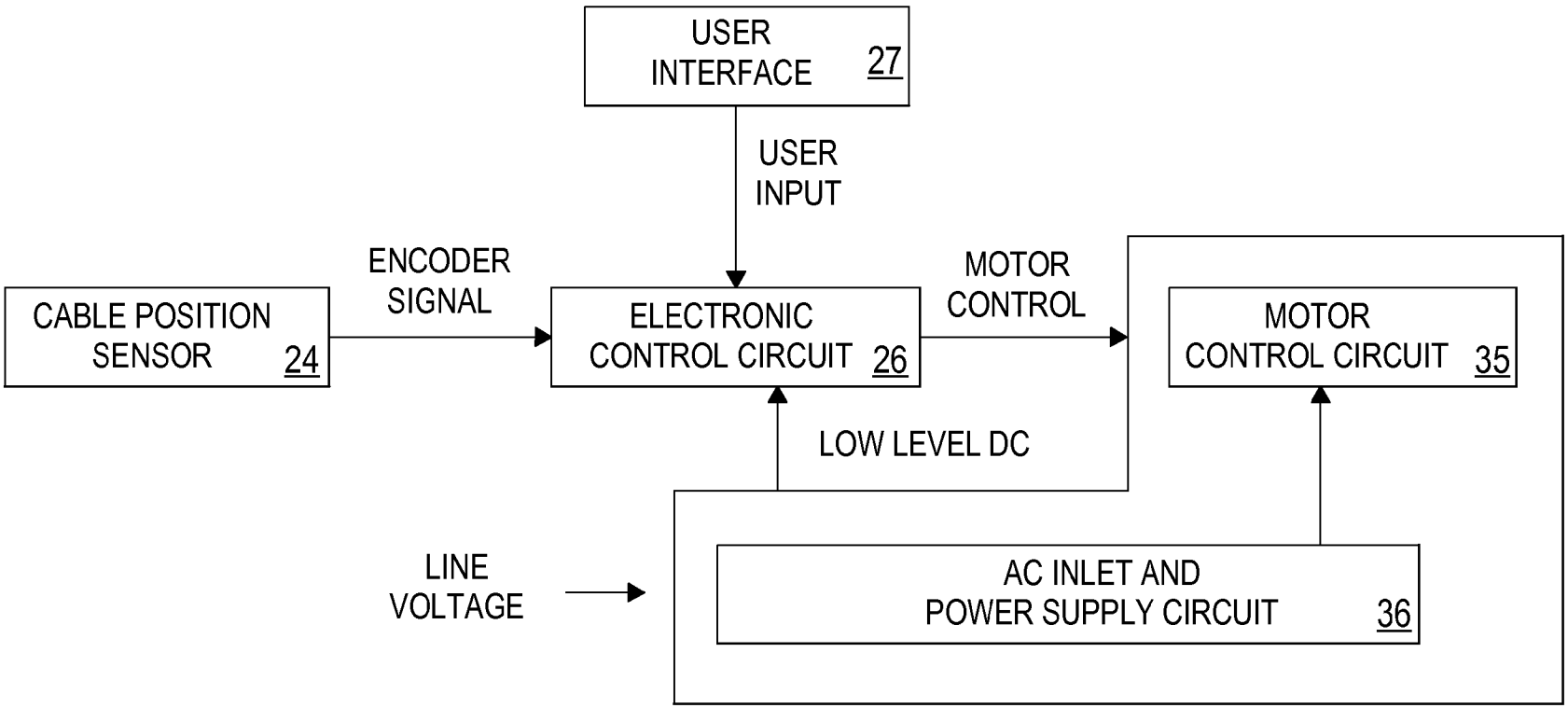
FIG. 5 shows the electronic components of the programmable boatlift system.

FIG. 5 shows a block diagram of the electrical and functional components of the programmable boatlift system 10 of the present invention. An AC inlet and power supply circuit 36 interfaces with line voltage and provides for the power requirements of the circuitry. The power supply 36 provides 12 volt line voltage to a motor control circuit 35. A 5 volt line voltage is supplied to an electronic control circuit 26. This 5 volt line voltage can operate for a short period of time after external power is removed. This will allow the electronic control circuit 26 to record the boatlift cradle's 17 final absolute position at power-down in non-volatile memory, so as to eliminate the need to recalibrate the boatlift cradle's 17 position when power is restored. Motor control relays in the motor control circuit 35 turn the boatlift motor 18 on and off, in either direction, based upon input from the electronic control circuit 26.

The boat or cable position sensor 24 provides an output signal to the electronic control circuit 26 which uses this signal to infer the absolute position of the boatlift cradle 17. A user interface or keypad 27 allows a user to invoke the function of the programmable boatlift system 10 through keys or push buttons. The electronic control circuit 26 encompasses all logical operations of the circuitry and interfaces with the cable position input and user interface/keypad input to control the lift motor on/off and direction.

Figure 6:
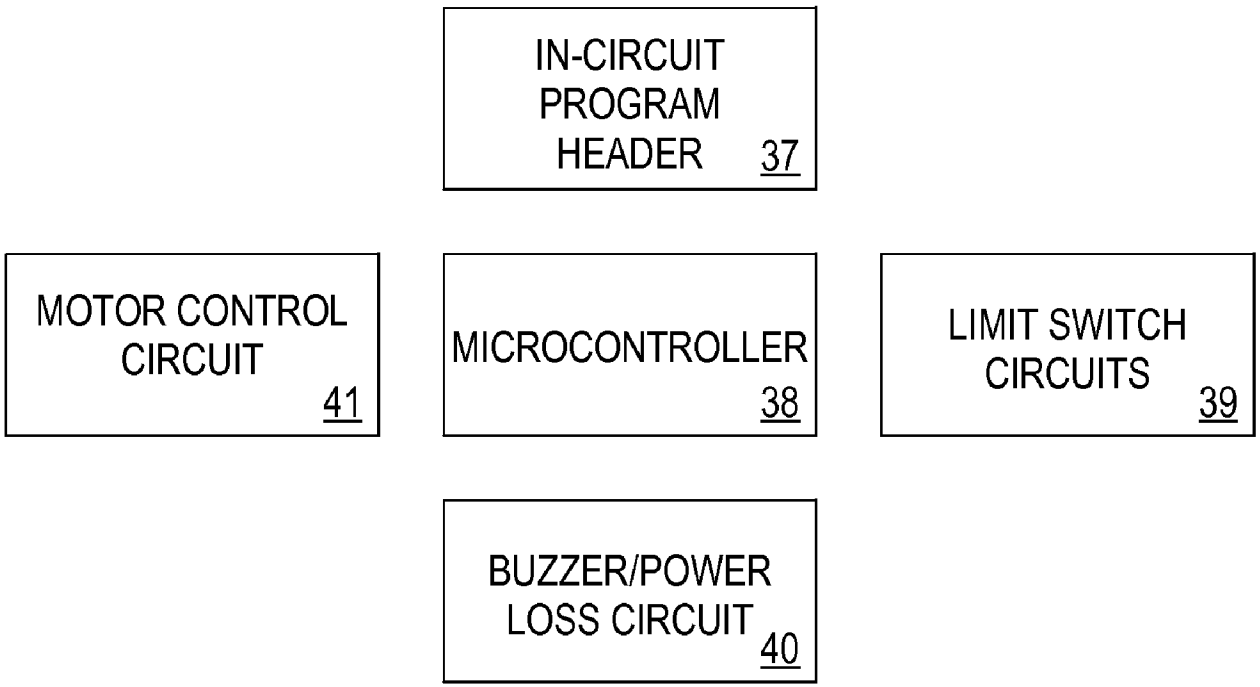
FIG. 6 shows the electronic components of the electronic control circuit.
Figure 7:
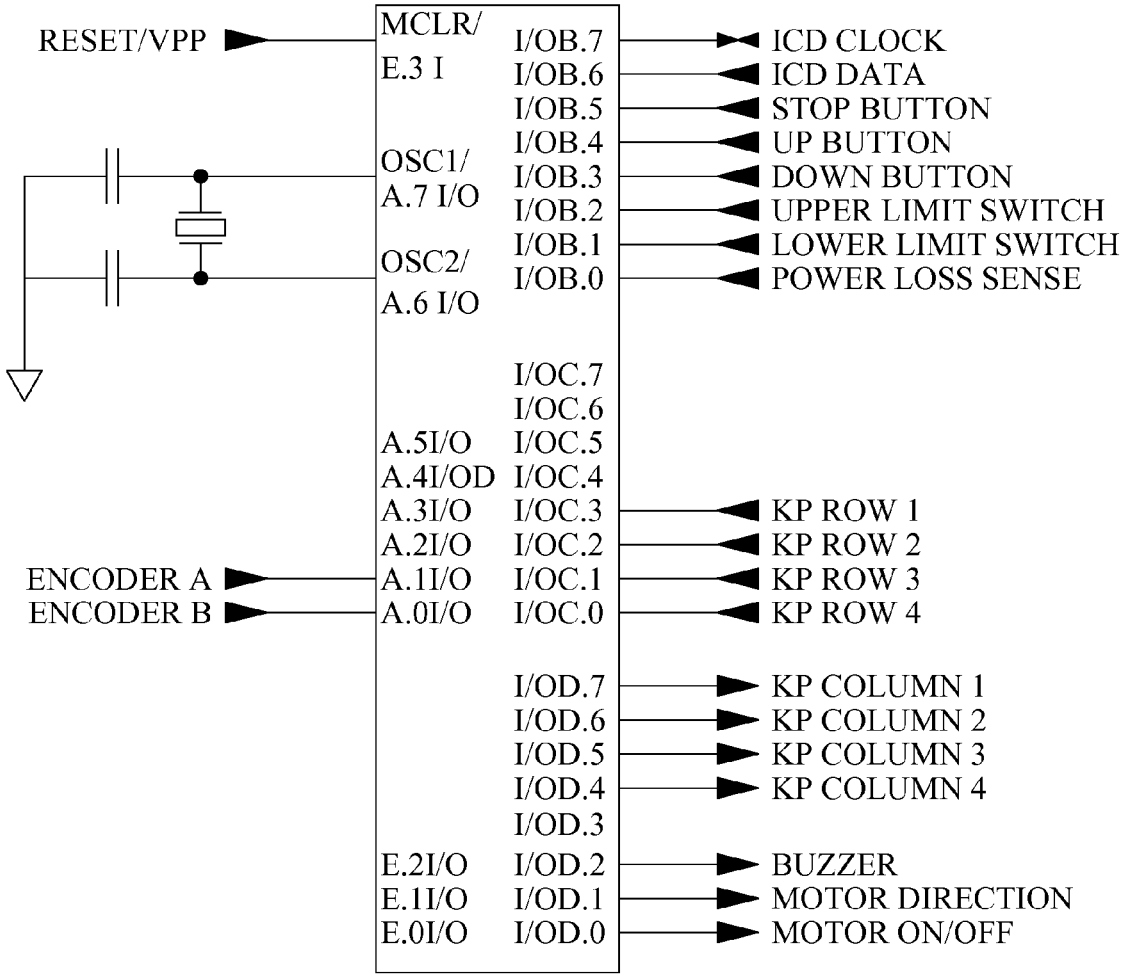
FIG. 7 is an electrical schematic of the microcontroller of the electronic control circuit.
Figure 8:
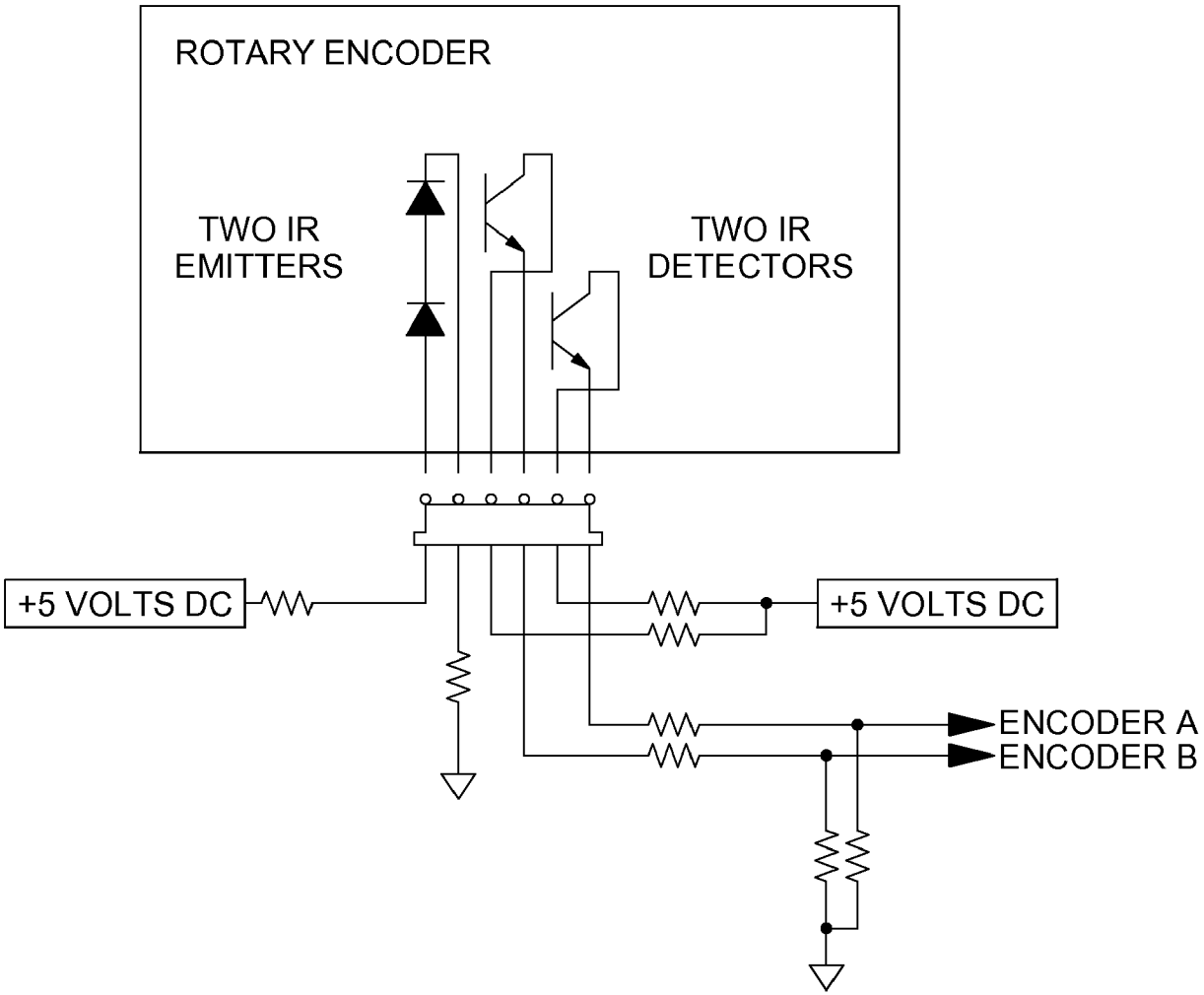
FIG. 8 is an electrical schematic of the rotary encoder and connector of the boat position sensor.
Figure 9:
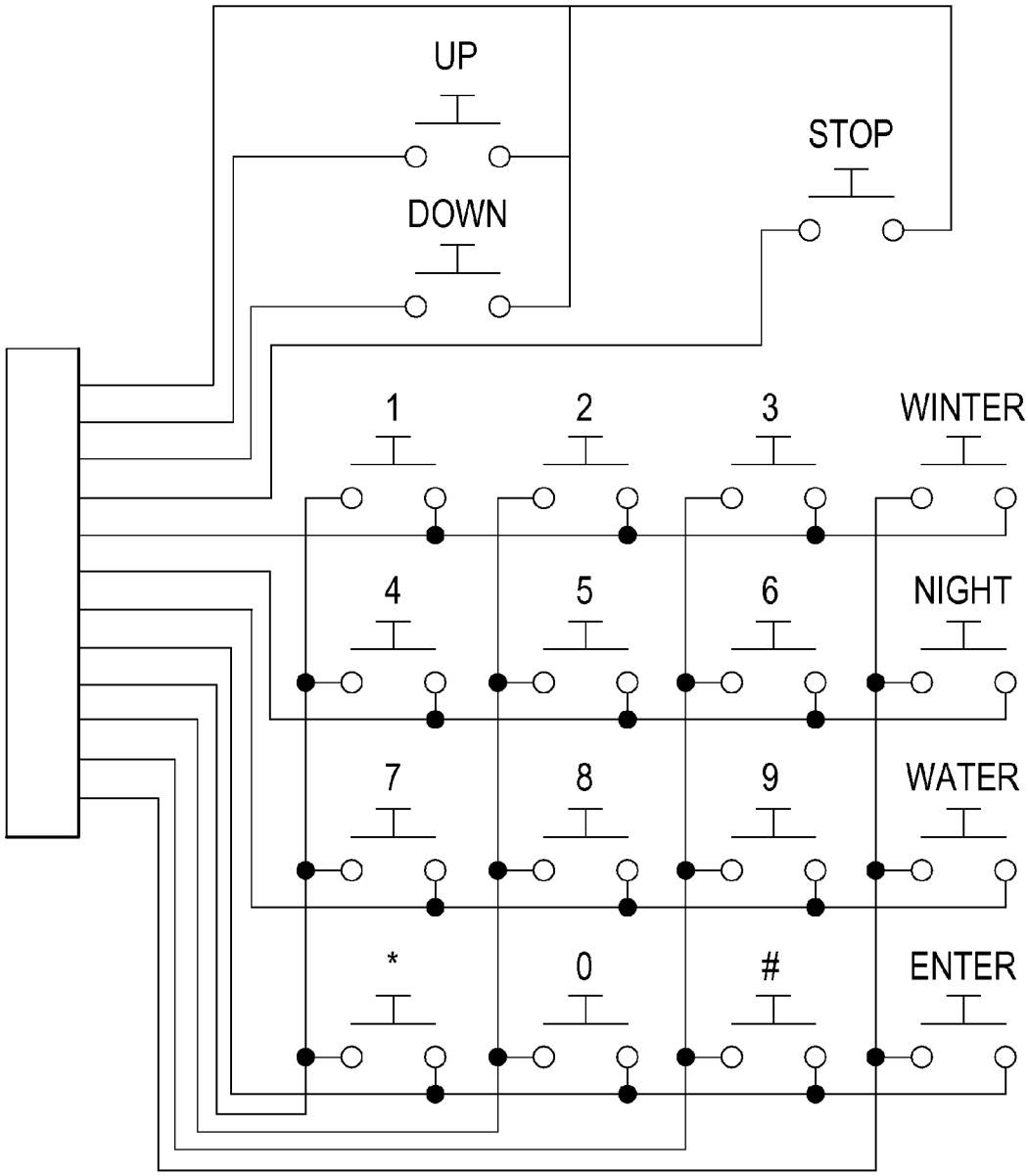
FIG. 9 is an electrical schematic of the user keypad interface.

The components of the electronic control circuit 26 are shown in FIG. 6. It consists of a microcontroller 38 with non-volatile memory, an oscillator, and related circuitry to interface with all other parts of the circuitry. Electronic control circuit 26 also contains an in-circuit programming header 37, a motor control circuit 41, limit switch circuits 39, and a buzzer/power loss circuit 40. FIG. 7 shows an electrical schematic of a microcontroller 38. FIG. 8 shows an electrical schematic of the rotatory encoder 34 and connector. FIG. 9 shows an electrical schematic of the user keypad 27 and connector. A remote control unit can also be used to operate the user keypad 27. A user can press up, down, or stop keys to make the boatlift cradle 17 go up or down or stop at any desired position. An enter key can be used to program the electronic control circuit 26 to raise and lower the boatlift cradle a desired amount by pressing other keys, such as, for example, keys labeled "winter", "night", "water", etc. The electronic control circuit 26 is programmable to automatically turn off the motor 18 after a fixed number of rotations of the idler sheave 25 in one direction, and after the same fixed number of rotations in an opposite direction, and at any amount of rotations there between.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, various types of known microprocessing, memory, and programming devices may be used in the electronic control circuit. Various types of rotary encoders known in the art may be used with the idler sheave. Other emitters and detectors may be used in the encoder besides infrared. The electronic control circuit can be programmed to lock after a certain amount of time for security purposes, and a pass code can be entered into the user key pad to unlock the electronic control circuit. The electronic control circuit can be programed to produce an alarm before the motor is turned on. A wireless remote device can be used to access the electronic control circuit and/or user key pad. One or more limit switches can be used for safety purposes to turn off the motor in case of a malfunction in the system.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A programmable boat lift system having a single motor, comprising:

a) a single first cable extending up from one end of a first boatlift cradle, and down to an opposite end of the first boatlift cradle, the single first cable being attached to a shaft therebetween, the shaft being attached to the motor;

b) a single idler sheave having a plurality of holes for the transmission of light, said idler sheave constructed to engage the single first cable and to rotate on an axis as the single first cable moves across said idler sheave;

c) a quadrature encoder having two pairs of IR transmitters and IR receivers, said encoder placed over said idler sheave, said two pairs of IR transmitters and IR receivers being set apart about 165 degrees relative to said axis of said idler sheave;

d) said IR transmitters transmitting infra red light through the holes in said sheave and said IR receivers receiving said infra red light so that said encoder produces an electronic output signal in proportion to the number of rotations of said sheave, and in proportion to the distance the single first cable travels over said idler sheave, as the single first cable moves across said idler sheave; and e) an electronic control circuit having a microcontroller, an in-circuit programming header; and a motor control circuit, said control circuit programmable to use said output signal to infer the exact position of the single first cable and the boat lift cradle without the requirement of a limit switch.

2. The boatlift system of claim 1 wherein said electronic control circuit is programmable to automatically turn off said motor after a fixed number of rotations of said idler sheave in one direction, and after said fixed number of rotations in an opposite direction, and after any amount of rotations therebetween as desired.

3. The boatlift system of claim 1 further comprising a second boatlift cradle and a single second cable, with the single second cable extending up from one end of the second boatlift cradle, across to the shaft, and down to an opposite end of the second boatlift cradle, the single second cable being attached to the shaft.

4. A programmable boat lift system having a single motor, comprising:

a) a single first cable extending up from one end of a first boatlift cradle, and down to an opposite end of the first boatlift cradle, the single first cable being attached to a shaft therebetween, the shaft being attached to a motor;

b) a single idler sheave having a plurality of holes for the transmission of light, said idler sheave constructed to engage the single first cable and to rotate on an axis as the single first cable moves across said idler sheave;

c) a quadrature encoder having two pairs of IR transmitters and IR receivers, said encoder placed over said idler sheave, said two pairs of IR transmitters and IR receiver being set apart about 165 degrees relative to said axis of said idler sheave;

d) said IR transmitters transmitting infra red light through the holes in said sheave and said IR receivers receiving said infra red light so that said encoders produces an electronic output signal in proportion to the number of rotations of said sheave, and in proportion to the distance the single first cable travels over said idler sheave, as the single first cable moves across said idler sheave;

e) an electronic control circuit having a microcontroller, an in-circuit programming header; and a motor control circuit, said control circuit programmable to use said output signal to infer the exact position of the single first cable and the boat lift cradle without the requirement of a limit switch; and f) said electronic control circuit is programmable to automatically turn off said motor after a fixed number of rotations of said idler sheave in one direction, and after said fixed number of rotations in an opposite direction, and after any amount of rotations therebetween as desired.

5. The boatlift system of claim 4 further comprising a second boatlift cradle and a single second cable, with the single second cable extending up from one end of the second boatlift cradle, across to the shaft, and down to an opposite end of the second boatlift cradle, the single second cable being attached to the shaft.

6. A programmable boat lift system having a single motor, comprising:

a) a single first cable extending up from one end of a first boatlift cradle, and down to an opposite end of the first boatlift cradle, the single first cable being attached to a shaft therebetween, the shaft being attached to a motor;

b) a single idler sheave having a plurality of holes for the transmission of light, said idler sheave constructed to engage the single first cable and to rotate on an axis as the single first cable moves across said idler sheave;

c) a quadrature encoder having two pairs of IR transmitters and IR receivers, said encoder placed over said idler sheave, said two pairs of IR transmitters and IR receivers being set apart about 165 degrees relative to said axis of said idler sheave;

d) said IR transmitters transmitting infra red light through the holes in said sheave and said IR receivers receiving said infra red light so that said encoder produces an electronic output signal in proportion to the number of rotations of said sheave, and in proportion to the distance the single first cable travels over said idler sheave, as the single first cable moves across said idler sheave;

e) an electronic control circuit having a microcontroller, an in-circuit programming header; and a motor control circuit, said control circuit programmable to use said output signal to infer the exact position of the single first cable and the boat lift cradle without the requirement of a limit switch;

f) said electric control circuit is programmable to automatically turn off said motor after a fixed number of rotations of said idler sheave in one direction, and after said fixed number of rotations in an opposite direction, and after any amount of rotations therebetween as desired; and g) a second boatlift cradle and a single second cable, with the single second cable extending up from one end of the second boatlift cradle, across to the shaft, and down to an opposite end of the single second boatlift cradle, the second cable being attached to the shaft.

* * * * *